United States Patent [19]

Thompson, Jr. et al.

[11] Patent Number: 4,909,012

[45] Date of Patent: Mar. 20, 1990

[54] METHOD OF USING COMPRESSION FASTENER FOR JOINING STRUCTURAL MEMBERS

[76] Inventors: Ransom S. Thompson, Jr.; Chester B. Schmeelk, both of 37 Old Mill Rd., West Ossipee, N.H. 03890

[21] Appl. No.: 387,839

[22] Filed: Aug. 1, 1989

Related U.S. Application Data

[63] Continuation-in-part of Ser. No. 250,104, Sep. 28, 1988.

[51] Int. Cl.[4] ..... E04B 1/00; E04B 1/10

[52] U.S. Cl. ..... 52/741; 52/233; 52/573; 411/343; 411/153; 411/544; 267/33; 446/106

[58] Field of Search ..... 446/106, 111, 113, 116; 411/343, 153, 544; 52/227, 573, 741, 233; 267/152, 179, 202

[56] References Cited

U.S. PATENT DOCUMENTS

| | | | |
|---|---|---|---|
| 802,622 | 10/1905 | Van Den Bulcke | 52/741 |
| 1,783,383 | 12/1930 | Montrief | 52/573 |
| 2,005,089 | 6/1935 | Krebs | 267/33 |
| 2,212,990 | 8/1940 | Maler | 52/403 |
| 2,373,394 | 4/1948 | Hall | 52/16 |
| 2,466,613 | 4/1949 | Richardson | 52/227 |
| 3,001,252 | 9/1961 | Erickson et al. | 411/343 |
| 3,183,762 | 5/1965 | Poupitch | 411/12 |
| 4,720,223 | 1/1988 | Neights et al. | 411/11 |

OTHER PUBLICATIONS

American Builder Publication, Feb. 1933, p. 33.

*Primary Examiner*—James L. Ridgill, Jr.
*Attorney, Agent, or Firm*—Richard C. Litman

[57] ABSTRACT

A method of wall construction using a compressive fastener for log building construction which acts to continuously maintain pressure between individual logs in a building wall which includes a plurality of logs in stacked configuration. Logs are joined by boring a row of bores in the top log and counterboring each bore as a receptacle for the head of the fastener and a concentric spring assembly, the bores being larger than the shank of the fastener as well as the spring assembly to allow the fasteners to freely vertically expand and contract. Once the bored log is stacked and aligned on the log immediately below it, the fasteners are inserted into the boreholes and driven or tightened until the spring assembly is partially compressed and the fastener heads are below the upper surface of the upper log. The compressive fasteners pull the logs together to overcome long-term shrinkage and the continuous expanding and contracting caused by climatic changes.

6 Claims, 1 Drawing Sheet

METHOD OF USING COMPRESSION FASTENER FOR JOINING STRUCTURAL MEMBERS

CROSS-REFERENCE TO RELATED APPLICATIONS

This application is a continuation-in-part of previous application Ser. No. 07/250,104 filed Sept. 28, 1988.

FIELD OF THE INVENTION

This invention relates generally to fastener devices and a method of using such for joining structural members which periodically expand and contract, most particularly for buildings in which the walls are constructed of stacked wooden logs.

DESCRIPTION OF THE RELATED ART

Wooden logs used in log building are often green, having been recently felled and inadequately dried. Until dry, green logs have a tendency to warp, bend and contract. Even when seasoned, wood still expands and contracts with climatic changes, high humidity causing expansion and dryness causing contraction. It has been demonstrated that logs in new log buildings shrink more or less continuously for three or four years until they have shrunk laterally as much as 4 percent. All this time they have tended to warp and bend, expand and contract.

The dimensional changes are, therefore, of two kinds; the permanent shrinkage occurring over time and the continuous expansion and contraction caused by the weather. Both changes have adverse affects on the building structure, generally requiring remedial action.

The first and most noticeable changes are caused by permanent shrinking of each log, resulting in gaps between adjacent logs which let in air and water. Within two years after a log building is constructed, it is common practice to caulk between all the logs to restore the building integrity. In time, as further shrinkage occurs, further repairs may be necessary until the building finally stabilizes.

The second effect, caused primarily by the cyclic expansion and contraction of the logs, is a tendency for the fasteners joining the logs to loosen.

Log buildings are traditionally constructed by stacking horizontally disposed logs one on top of the other, and nailing or screwing each log to the one below it with spikes or log screws. These fasteners are normally driven vertically downwardly, although some builders prefer driving them at various angles for improved joining.

Both log nails and log screws are subjected to increased tension when a log expands, compressing the wood under the fastener heads and occasionally loosening the grip of the fastener in the hole.

Several prior art solutions have been practiced to relieve or at least compensate for this problem. Mating grooves or other formations are usually provided in the upper and lower faces of each log and one solution has been to employ a fitted gasket or barrier within the space between the two grooves, the gasket adaptably moving when the logs shift with respect to each other. Another, more basic approach, has been to apply a compliant gasket sandwiched between the longitudinal mating surface of two stacked logs. It is also known to use an elastic viscous fluid gasket material, spread on the horizontal mating surfaces of the logs before joining, and/or introduced between the logs after the building is complete. An alternative manner of dealing with the problem has been to erect insulative foam or other sheets adjacent the inner face of the log wall after assembly to seal it and reduce heat transmission.

The present invention provides an apparatus to overcome the above shortcomings by presenting improved means to compressively join sequentially stacked logs whereby dimensional changes in the logs will not terminally lessen the compressive forces being applied by the fasteners.

SUMMARY OF THE INVENTION

Accordingly, it is an object of the present invention to provide a method using a compressive fastener assembly for joining elongated structural members subject to long-term shrinkage whereby the force produced by the fastener is maintained throughout the excursion caused by the shrinkage.

Another object of the present invention is to provide a method using a compressive fastener for joining structural members subject to expansion whereby the joining force produced by the fastener remains throughout the excursion caused by this expansion.

It is a further object of the present invention to provide a method using an elongated spring member adapted for concentrically mounting about the shank of a standard headed driven fastener as used in securing stacked longitudinal members subject to expansion and contraction.

Still another object of the present invention is to provide a method using an annular or helical unit spring for concentrically mounting about the shank of a standard headed screw fastener and including a resilient element sandwiched between a pair of washer devices and with a collapsible cover shrouding the unit.

Another object of the invention is to provide a method using a compressive fastener which can be installed by standard spike-driving driving or screw-driving means.

The present invention will be better understood from the following detailed description of a preferred embodiment. This description makes reference to the accompanying drawings, in which:

DESCRIPTION OF THE PREFERRED EMBODIMENTS

Figure 1:
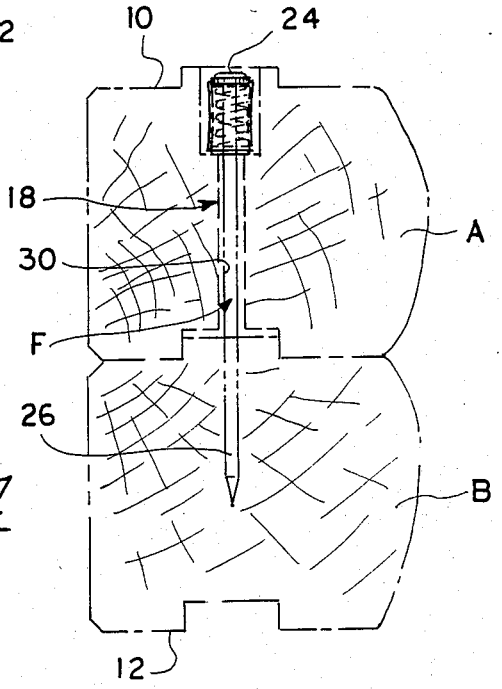
FIG. 1 is an elevational view showing an upper structural member secured to a lower structural member by a driven compressive fastener assembly according to the present invention.
Figure 2:
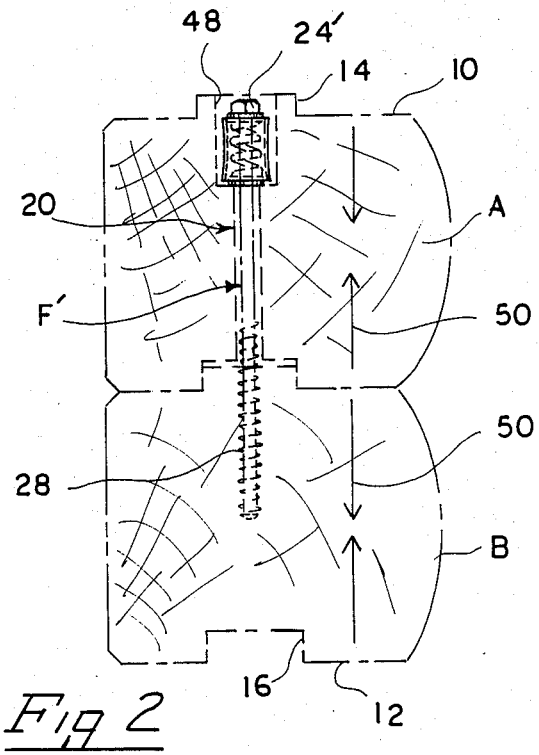
FIG. 2 is a view similar to FIG. 1, of the invention in combination with a threaded fastener member.

Referring now to the drawings, particularly FIGS. 1 and 2, the present invention will be understood to relate to an improvement in fasteners associated with building construction, particularly buildings assembled from elongated structural members which are subject to continual lateral or radial expansion and contraction. The structural members A and B are shown as depicting logs as used in the construction of buildings and wherein, the logs are usually preliminarily shaped to facilitate the subsequent vertical stacking and assembly thereof. Such shaping includes the formation of substantially planar top and bottom surfaces 10, 12 respectively. To provide an orientation and interlock between adjacent, stacked members A,B, the top and bottom surfaces 10,12 are preferably provided with mating tongues 14 and grooves 16.

Figure 3:
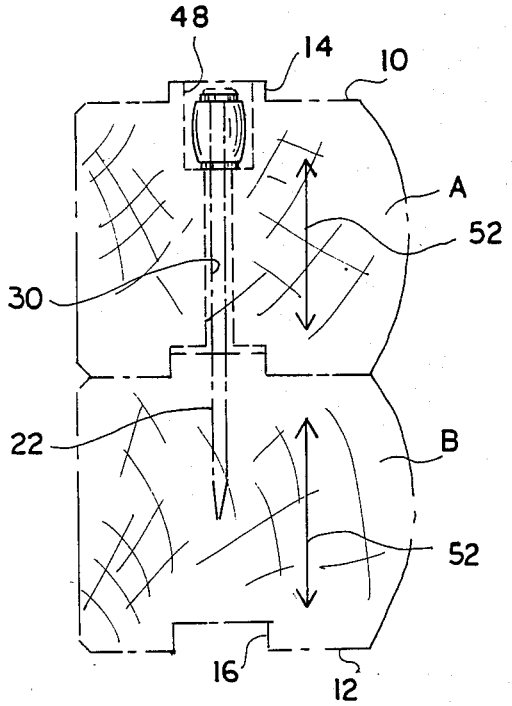
FIG. 3 is a view similar to FIG. 1, illustrating the assembly as it appears immediately following installation.

The anchor assembly of the present invention may comprise the driven anchor assembly 18 of FIGS. 1 and 3 or, the screw anchor assembly 20 of FIG. 2. In each instance, the anchor assembly includes an elongated fastener F or F' having a shank 22 provided with an enlarged head 24 or 24'. In the case of the driven anchor, the fastener leading end 26 will be seen to be pointed while with the screw anchor, the fastener F' includes a threaded leading end 28.

To achieve a positive anchoring of any two vertically adjacent logs A and B, one or the other above type anchor assemblies 18,20 are employed to yieldingly secure a plurality of stacked, longitudinally extending structural members. In preparation for the reception of the anchors, the uppermost one of each log being secured is provided with a guide bore 30, the diameter of which preferably provides an interference-free fit relative the shank portion 22 of the fastener F or F'. A suitable pilot hole may be formed in the next below log B, in axial alignment with the guide bore 30 and the size of which will depend upon whether the fastener is a spike as in FIGS. 1 and 3 or, a screw member as in FIG. 2.

In any installation according to the present invention, captive spring means 32 is carried by the fastener shank, immediately beneath the head 24,24' and comprises resilient compensating means serving to accommodate both expansion and shrinking of the logs. As shown most clearly in FIG. 4, the compensator 32 includes a spring member 34 having opposite ends 36,38 respectively engaged by washer elements 40,42. Each of the members 34,40,42 includes a central bore or opening, freely allowing passage of the fastener shank 22 while the bore 44 of at least the topmost washer 40 is of a diameter precluding passage of the fastener head 24 or 24'.

The spring member 34 may comprise any of various configurations such as the illustrated helical, coiled spring or alternately, a belleville washer or other type of compression biasing device. The diameter of the spring member 34 preferably is no greater than that of the end washers 40,42 for reasons which will now become apparent. The ends of the spring member may be suitably affixed to the respective washers 40,42 such as by welding, adhesives, or soldering. Surrounding the spring member is a shroud or casing 46 of appropriate pliant material such as synthetic rubber or the like and which may optionally have its two ends suitably adhered to the respective washers so that a unitary compressible, spring assembly is provided.

Figure 4:
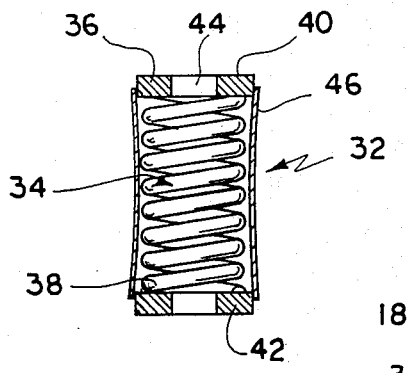
FIG. 4 is an enlarged elevational view, partly in section, of the spring assembly of the invention.

FIG. 4 will be understood to illustrate the spring assembly 32 as it appears in the at-rest state that is, wherein the spring element 34 is relaxed, with noticeable spaces between the various convolutions and the casing 46 is substantially fully extended.

In use, a complete anchor assembly will include a spring assembly 32 with one or the other fastener members F or F' inserted therethrough and the selected anchor assembly is utilized by providing a counterbore 48 within the confines of the tongue portion 14 on the top face of each structural member or log A,B. As shown in the drawings, the vertical extent of the counterbore is no less than that of the height of the spring assembly 32 plus that of the fastener head 24 or 24' while the diameter of the counterbore is at least slightly greater than the diameter of the shrouded spring assembly when in the maximum compressed state as in FIG. 3.

When an anchor assembly 18 or 20 is driven or threaded into an assembled position, its leading end 26 or 28 is advanced into the next lower log B a sufficient distance until the spring assembly spring member 34 is fully compressed. FIG. 1 may be considered to reflect such an initial installed position of the various components. Depending upon the moisture content of the logs A,B as well as the ambient weather conditions, the logs initially will either expand or contract, respectively increasing and decreasing the height of each log or, the distance between each log's top and bottom surfaces 10,12.

As the above described swelling and contraction of the logs takes place, a substantially constant clamping action is delivered by the anchor assemblies serving to retain each adjacent pair of logs in place. Since the lower or leading end 26,28 of the fasteners is fixedly disposed within the lowermost one of the logs, and variation in the overall vertical height of adjacent pairs of logs produces a vertical shifting of the counterbores 48 thereby altering the effective length or height of the plurality of spring assemblies 32 associated with that uppermost log A.

FIG. 2 represents the relationship when the logs A,B have shrunk and whereby the top and bottom faces thereof have in effect moved in the direction of the arrows 50, such as during periods of elevated temperatures and low humidity. Under these conditions, the normal forces acting upon the compression spring member 34 are slightly relaxed thereby allowing the convolutions of the spring to vertically expand. On the other hand, under high humidity conditions, the logs A,B will absorb moisture and expand, such as reflected by the arrows 52 in FIG. 3. With this situation, the counterbores 48 in the uppermost log A will become elevated with respect to the lowermost log B thereby further compressing the spring members 34 along with the respective casings 46. Under both circumstances, the spring members 34 continue to exert a definite upward force upon the head 24,24' of the fastener F or F' to insure maintenance of a positive clamping action upon the assembled logs A,B, thus insuring a constant, firm assemblage of the structural members throughout alternate contraction and expansion of the logs or other members.

It is to be understood that the present invention is not limited to the sole embodiment described above, but encompasses any and all embodiments within the scope of the following claims.

We claim:

1. A method for securing together a plurality of stacked elongated structural elements made of natural unprocessed wood subject to periodic vertical expansion and contraction comprising the following steps:

providing the lower surface of each said structural element with a longitudinal groove and the upper surface of each said structural element with a longitudinal tongue, such that said lower groove and upper tongue mate together for successive stacked structural elements;

providing both longitudinal ends of each successive said structural element with vertical bores therethrough completely, each said successive structural element bores also having two topmost counterbores;

inserting into each said bore and counterbore a fastener and spring assembly, said fastener including a shank having an uppermost head and lowermost leading end, said spring assembly surrounding said shank and abutting said head, said spring assembly including a compression spring member;

said fasteners installed with said shanks through said vertical bores with an interference-free fit, said spring assemblies disposed within said counterbores and said leading ends fixedly embedded within a lower one of said structural elements; and said spring members being fully compressed when installed allowing for both the initial shrinkage of said structural elements and the vertical expansion and compression thereof as the successive structural members expand and contract, due to the weather, in a vertical direction, whereby during vertical expansion and contraction of the structural members a substantially constant biasing force is applied against said fastener heads to maintain the stacked structural members in a positive clamped relationship.

2. The method of securing according to claim 1, including providing said shank leading end with a substantially smooth periphery terminating in a point.

3. The method of securing according to claim 1, including providing said shank leading end with a threaded periphery.

4. The method of securing according to claim 1, including providing said spring member with a helical form.

5. The method of securing according to claim 1, including providing a pliant casing surrounding said spring member.

6. The method of securing according to claim 1, including providing that said spring means includes a compression spring bounded by a washer at both ends, said washers having a central bore providing an interference-free fit about said fastener shank.

* * * * *